United States Patent [19]

Deutsch

[11] Patent Number: 4,735,123

[45] Date of Patent: Apr. 5, 1988

[54] GENERATION OF TIME VARIANT HARMONIES IN AN ELECTRONIC MUSICAL INSTRUMENT

[75] Inventor: Ralph Deutsch, Sherman Oaks, Calif.

[73] Assignee: Kawai Musical Instrument Mfg. Co., Ltd., Hamamatsu, Japan

[21] Appl. No.: 923,512

[22] Filed: Oct. 27, 1986

[51] Int. Cl.[4] ..... G10H 1/06; G10H 7/00

[52] U.S. Cl. ..... 84/1.19; 84/1.22; 84/1.28

[58] Field of Search ..... 84/1.01, 1.19–1.23, 84/1.28

[56] References Cited

U.S. PATENT DOCUMENTS

| | | | |
|---|---|---|---|
| 4,385,542 | 5/1983 | Deutsch et al. | 84/1.23 |
| 4,450,746 | 5/1984 | Deutsch | 84/1.22 X |
| 4,612,838 | 9/1986 | Nagashima et al. | 84/1.01 |
| 4,612,839 | 9/1986 | Sunada | 84/1.01 |
| 4,628,787 | 12/1986 | Nozawa | 84/1.22 X |

*Primary Examiner*—Stanley J. Witkowski
*Attorney, Agent, or Firm*—Ralph Deutsch

[57] ABSTRACT

A keyboard operated musical instrument is disclosed in which musical tones having a variable spectral content are produced from waveshape data values that read out from a stored set of waveshape data points. A second set of data values is computed at the same rate as the rate for sequentially reading out the stored set of data values. A data select means periodically selects a sequence of the read out waveshape data points followed by the selection of a sequence of points from the second set of data values. The selected data points are converted into audible musical tones. Provision is made for varying the shape of the second set of data values in a time dependent fashion as well as to vary the time for which each data set is selected.

7 Claims, 4 Drawing Sheets

GENERATION OF TIME VARIANT HARMONIES IN AN ELECTRONIC MUSICAL INSTRUMENT

BACKGROUND OF THE INVENTION

1. Field of the Invention

This invention relates to musical tone synthesis and in particular is concerned with an improvement for producing several tone variations from stored musical waveforms.

2. Description of the Prior Art

The most obvious method to imitate an acoustic musical instrument is to record the sound and to replay the recording in response to an actuated keyswitch on an array of keyswitches. An advantage attributed to a musical tone generation system using a stored replica of a musical waveshape is the ability to closely approximate the tone of an orchestral type musical instrument. One of the primary drawbacks in the practical implementation of this type of electronic musical tone generator lies in the very large number of stored data points that must be stored in a memory. The maximum amount of memory is associated with a tone generation system which uses a separate and distinct recording for each note played in the range of the musical instrument's keyboard. Some economy in the memory requirement has been made by using a single recording for several contiguous notes in an octave. This economy is based upon the tacit assumption that the waveshape for the imitated acoustic musical instrument does not change markedly for several such contiguous successive notes.

Electronic musical tone generators that operate by playing back recorded musical waveshapes which have been stored in a binary digital data format have been given the generic name of PCM (Pulse Code Modulation). A musical instrument of the PCM type is described in U.S. Pat. No. 4,383,462 entitled "Electronic Musical Instrument." In the system described in the patent, the complete waveshape of a musical tone is stored for the attack and decay portions of the musical tone. A second memory is used to store the remainder of the tone which comprises the release phase of the musical tone. The sustain phase of the musical tone is obtained by using a third memory which stores only points for a single period of a waveshape. After the end of the decay phase, the data stored in the third memory is read out repetitively and the output data is multiplied by an envelope function generator to create the amplitude variation for the sustain and release portions of the generated musical tone.

Because of the large amount of memory required for a digital waveform PCM musical tone generation system, it is desirable for economical considerations to employ techniques which use a single stored waveform as a basis from which a variety of musical tones can be generated. It is an object of the present invention to produce several different musical tones from a single stored musical waveshape.

SUMMARY OF THE INVENTION

A musical tone generator is described of the type in which a musical tone is generated by reading out preselected waveshape data points that are stored in a waveshape memory. These data points are read out sequentially at a memory advance rate corresponding to the fundamental frequency of a musical note associated with an actuated switch in an array of keyboard switches. A second set of waveshape data points are computed in response to the actuated keyswitch. The second set of waveshape points may have a fundamental frequency which is not the same as the fundamental frequency of the stored preselected waveshape data points.

A data select gating means periodically selects a contiguous sequence of the data points read out of the waveshape memory followed by a selection of a contiguous sequence of points from the second set of waveshape data points. The length of the two selection intervals may be unequal and can be varied in response to a control signal. The selected data points are converted to an analog musical waveshape which is then transformed into an audible musical sound.

BRIEF DESCRIPTION OF THE DRAWINGS

The detailed description of the invention is made with reference to the accompanying drawings.

DETAILED DESCRIPTION OF THE INVENTION

The present invention is directed toward a musical tone generator in which a musical waveshape is stored in a memory.

Figure 1:
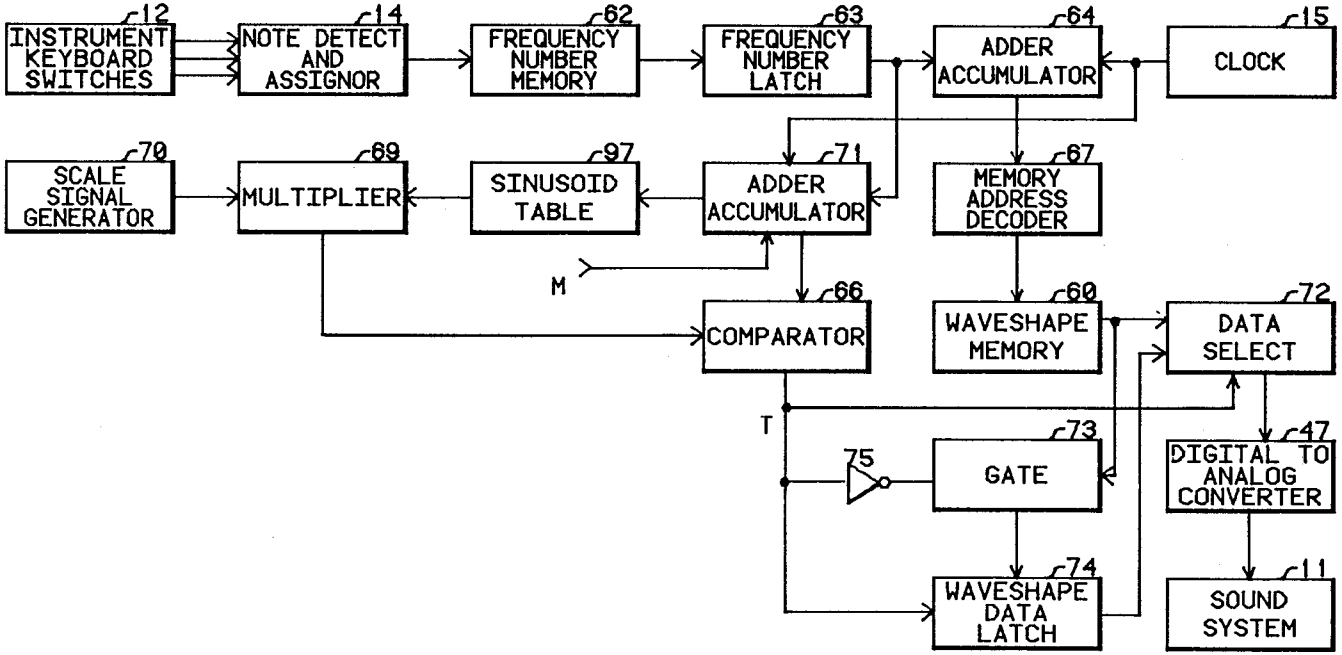
FIG. 1 is a schematic diagram of an embodiment of the invention.
Figure 4:
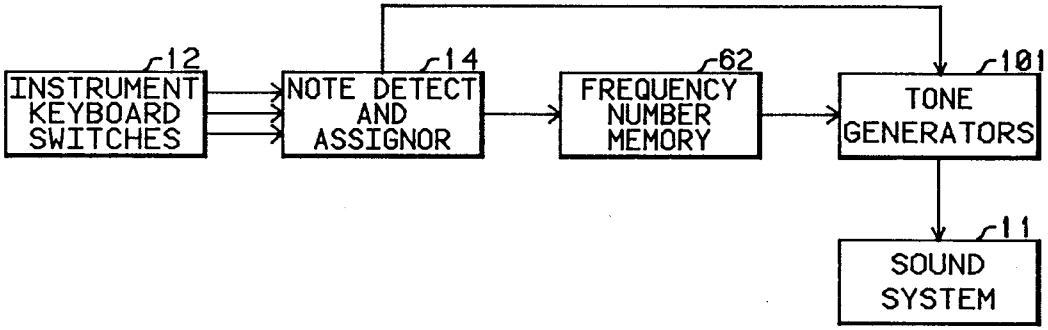
FIG. 4 is a system schematic drawing of the invention.

FIG. 4 illustrates an embodiment of the present invention as incorporated into a keyboard operated electronic musical instrument of the generic type in which musical tones are created by reading out stored waveforms from a waveshape memory. FIG. 1 illustrates an embodiment of the invention showing details of one of the tone generators in the system block of FIG. 4 labelled tone generators 101. The keyboard switches are contained in the system logic box labeled instrument keyboard switches 12. If one or more of the keyboard switches has a switch status change and is actuated ("on" switch position), the note detect and assignor 14 encodes the detected keyboard switch having the status change to an actuated state and stores the corresponding note information in a memory which is contained in the note detect and assignor 14. The encoded note information contains a designation of the frequency of an assigned tone generator. A tone generator is assigned to each actuated keyboard switching using the encoded detection data generated by and stored in the note detect and assignor 14.

Only a representative one of a plurality of tone generators, contained in the system block labelled tone generators 101 in FIG. 4, is shown in FIG. 1. The representative tone generator is composed of the system blocks 63,64,15,70,69,97,71,67,66,60,72,73,74 and 47. These blocks can be replicated for the other tone generators to provide for a polyphonic musical instrument.

A suitable configuration for a note detect and assignor subsystem is described in U.S. Pat. No. 4,022,098 entitled "Keyboard Switch Detect And Assignor." This patent is hereby incorporated by reference.

FIG. 1 explicitly shows only the details of a single tone generator. The other tone generators comprising the musical instrument are simply duplicates of the same system blocks.

When the note detect and assignor 14 finds that a keyboard switch has a switch status change to an actuated switch state, a frequency number corresponding to the actuated keyswitch is read from the frequency number memory 62 in response to the encoded detection information stored in the note detect and assignor 14. The frequency number memory 62 can be implemented as a read-only addressable memory (ROM) containing data words stored in digital binary numeric format having values $2^{(N-G)/12}$ where N has the range of values N=1,2, . . . , G and G is equal to the number of keyswitches on the instrument's keyboard. N designates the number of a keyswitch. These keyswitches are numbered consecutively from "1" at the lowest frequency keyboard switch. The frequency numbers represents ratios of the frequencies of generated musical tones with respect to the frequency of the system's logic clock. A detailed description of frequency numbers is contained in U.S. Pat. No. 4,114,496 entitled "Note Frequency Generator For A Polyphonic Tone Synthesizer." This patent is hereby incorporated by reference.

The frequency number read out from the frequency number memory 82 is stored in the frequency number latch 63.

The clock 15 provides a sequence of timing signals. In response to the sequence of these timing signals, the frequency number contained in the frequency number latch 63 is successively added to the content of an accumulator contained in the adder-accumulator 64. The content of this accumulator is called the accmulated sum of a frequency number. Since the frequency number has a numeric value which is less than or equal to one, the accumulated frequency number will consist of an integer portion and a decimal portion.

The memory address decoder 67 addresses out waveshape data points stored in the waveshape memory 60 in response to the integer portion of the accumulated frequency number contained in the adder-accumulator 64. The waveshape data points read out of the waveshape memory 60 are transferred to the data select 72 and to the gate 73.

In response to the sequence of timing signals produced by the clock 15, the frequency number contained in the frequency number latch 63 is successively added to the content of an accumulator contained in the adder-accumulator 71. This accumulator is implemented so that the result of the addition is modulo a prespecified number M. The number M is supplied to the accumulator in the adder-accumulator 71 by any suitable data select means such as a digital data key terminal. A variety of tonal effects can be obtained by changing the value M. M can be readily made a time variant constant.

The sinusoid table 97 can be implemented as an addressable random access memory (RAM) which stores values of the trigonometric offset function $1+\sin(2\pi d/Q)$. The constant $0 \leqq d \leqq Q$ represents the sinusoid table address. One choice for the resolution constant Q is to make Q equal the closest integer to the number of waveshape data points per period for the average steady state portion of the waveshape data points stored in the waveshape memory 60.

The data values read out from the sinusoid table 97 is multiplied by a scale factor by means of the multiplier 69. The scale factor is provided by the scale signal generator 70. The scale signal generator can be implemented in any of a numerous variety of digital data generators. One implementation of the scale signal generator 70 is a digital data key terminal. Variations in the magnitude of the scale signal will effect the spectra of the tones produces by the tone generator. In particular time variations of the scale signal produce desirable musical tonal effects. An ADSR envelope signal generator can be used as an implementation of the scale signal generator 70.

A suitable configuration for an ADSR envelope signal generator is described in U.S. Pat. No. 4,079,650 entitled "ADSR Envelope Generator." This patent is hereby incorporated by reference.

The comparator 66 compares the magnitude of the integer portion of the accumulated frequency number contained in the adder-accumulator 71 with the scaled data value produced by the multiplier 69. It is noted that the output of the multiplier 69 will always have a positive numeric value because the trigonometric function values stored in the sinusoid table 67 have been offset by +1 to provide a stored set of positive values.

If the output data from the multiplier 69 has a value greater than or equal to the integer portion of the accumulated frequency number contained in the adder-accumulator 71, the comparator 66 generates a signal T having a binary logic "1" state; otherwise the T signal will be generated with a binary logic "0" state.

If the signal T has a "0" state, then the inverter 75 inverts this signal to a "1" state. In response to T=0, the gate 73 transfers the waveshape data values read out of the waveshape memory 60 to the waveshape data latch 74. Each waveshape data value transferred by the gate 73 is stored in the waveshape data latch 74 and replaces the previously stored waveshape data value.

In response to the signal T=0, the data select 72 transfers the data point value read out from the waveshape memory 60 to the digital-to-analog converter 47. In response to the signal T=1, the data select 72 transfers the waveshape data point stored in the waveshape data latch 74 to the digital-to-analog converter 47.

The digital-to-analog converter 47 converts the input sequence of digital data values to an analog musical waveshape. The sound system 11 converts the musical waveshape to an audible musical sound. The sound system 11 consists of a conventional amplifier and speaker combination.

The net result of the system operation described above is that a selected portion of the musical waveshape stored in the waveshape memory 60 is periodically maintained at a constant value for a predetermined number of waveshape data points. This action produces additional harmonics for the stored musical waveshape as well as a controlled production of overtones which are not limited or restricted to be true harmonics of the generated musical tone's fundamental frequency.

Figure 2:
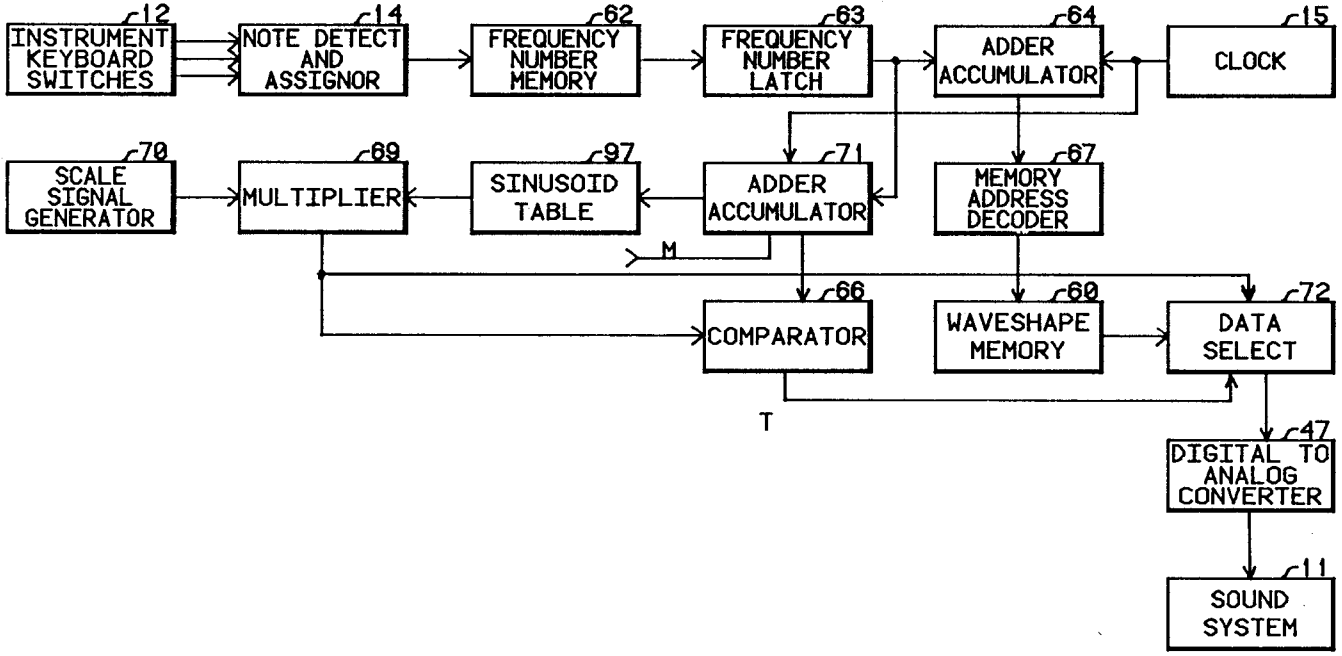
FIG. 2 is a schematic diagram of an alternate embodiment of the invention.

An alternative embodiment of the present invention is shown in FIG. 2. In this embodiment the output of the multiplier is alternately sent to the data select 72 instead of a stored waveshape data point that is transmitted in the version of the invention shown in FIG. 1 and previously described.

In response to the signal T="1" generated by the comparator 66, the data select 72 selects the output data value produced by the multiplier 69 to be transferred to the digital-to-analog converter 47. If T="0", the data select 72 selects the output data value read out from the waveshape memory 60 to be transferred to the digital-to-analog converter 47.

Figure 3:
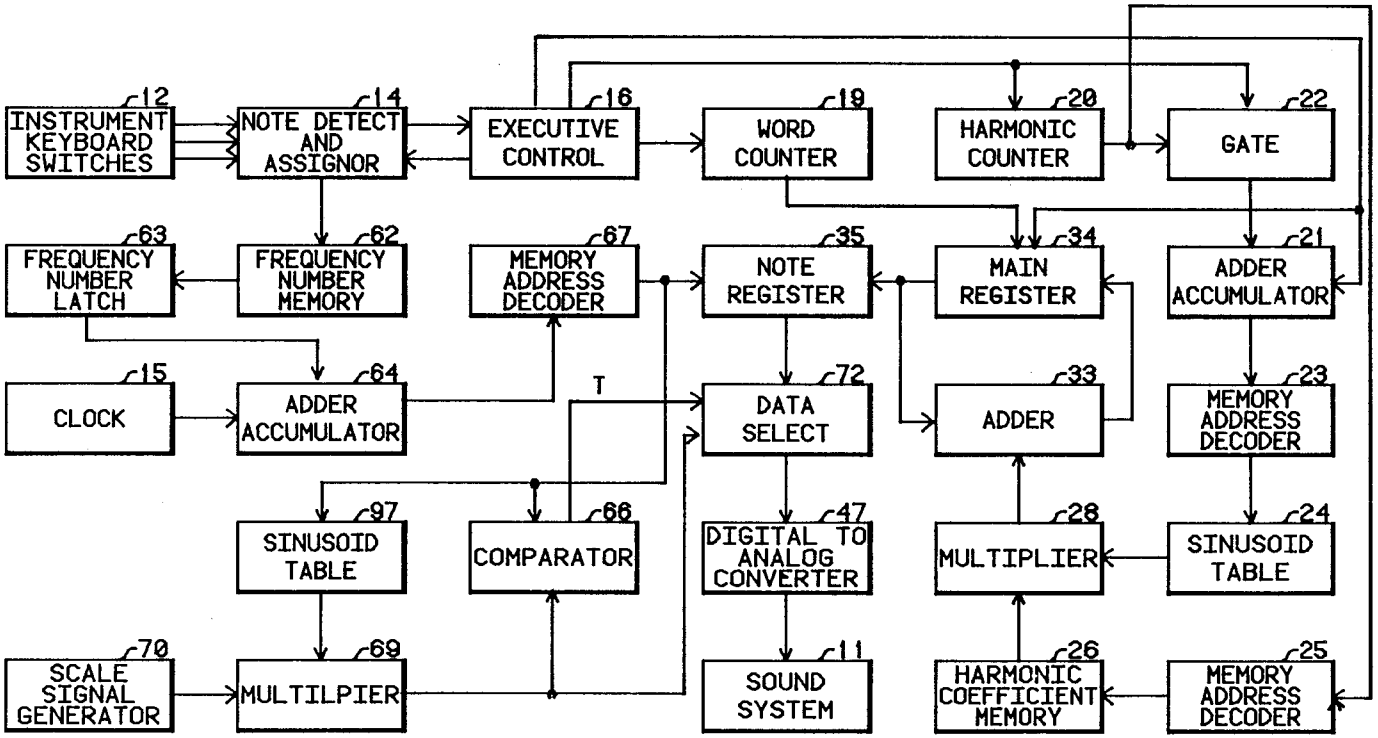
FIG. 3 is a schematic diagram of the invention incorporated into a Polyphonic Tone Synthesizer.

FIG. 3 illustrates an implementation of the present invention incorporated into a musical tone generator of the type described in U.S. Pat. No. 4,085,644 entitled "Polyphonic Tone Synthesizer." This patent is hereby incorporated by reference. In the following description all elements of the system which are described in the referenced patent are identified by number less than 60 which correspond to the same numbered elements appearing in the referenced patent.

If one or more of the keyboard switches contained in the box labeled instrument keyboard switches 12 has a switch status change and is actuated, the note detect and assignor 14 encodes the detected keyboard switch having the status change to an actuated state and stores the corresponding note information for the actuated keyswitches.

When one or more keyswitches have been actuated, the executive control 16 initiates a repetitive sequence of computation cycles. During each computation a master data set comprising 64 data words is computed and stored in the main register 34. The master data set values correspond to the amplitudes of 64 equally spaced points of one cycle of a waveform for musical tone. The choice of 64 points for the master data set provides a waveshape in which the maximum number of harmonics is no greater than 32 or no greater than one-half of the number of data points comprising the master data set.

As described in the referenced U.S. Pat. No. 4,085,644, it is desirable to be able to continuously recompute and store the master data set during a repetitive sequence of computation cycles and to load the master data set into note registers while the actuated keyswitches remain actuated, or depressed, on the keyboards.

The harmonic counter 20 is initialized to its minimal, or zero, count state at the start of each computation cycle. Each time that the word counter 19 is incremented by the executive control 16 so that it returns to its minimal, or zero, count state because of its modulo counting implementation, a signal is generated by the executive control 16 which increments the count state of the harmonic counter 20. The word counter 19 is implemented to count modulo 64 which is the number of data words comprising the master data set.

At the start of each computation cycle, the accumulator in the adder-accumulator 21 is initialized to a zero value by the executive control 16. Each time that the word counter 19 is incremented the adder-accumulator 21 adds the current count state of the harmonic counter 20 to the sum contained in the accumulator. This addition is implemented to be modulo 64.

The content of the accumulator in the adder-accumulator 21 is used by the memory address decoder 23 to access out trigonometric values from the sinusoid table 24. The sinusoid table 24 is advantageously implemented as an addressable read only memory storing values of the trigonometric function $\sin(2\pi\phi/64)$ for $0 \leqq \phi \leqq 64$ at intervals of D. D is a table resolution constant.

The memory address decoder 25 is used to read out harmonic coefficients stored in the harmonic coefficient memory 26. The harmonic coefficient memory 26 stores 32 harmonic coefficients which correspond to the 32 harmonics of the musical waveshape defined by the master data set.

The multiplier 28 generates the product value of the trigonometric function value read out from the sinusoid table 24 and the value of the harmonic coefficient read out from the harmonic coefficient memory 26. The generated product value formed by the multiplier 28 is furnished as one input to the adder 33.

The contents of the main register 34 are initialized to a zero value by the executive control 16 at the start of each computation cycle. Each time that the word counter 19 is incremented, the content of the main register 34 at an address corresponding to the count state of the word counter 19 is read out and furnished as an input to the adder 33. The sum of the two input data values provided to the adder 33 is stored in the main register 34 at a memory address location associated with the count state of the word counter 19. After the word counter 19 has been cycled for 32 complete cycles of 64 counts, the computation cycle is completed and the master data set resides in the main register 34.

Following each computation cycle in the repetitive sequence of computation cycles, a transfer cycle is initiated and executed. During a transfer cycle the master data is copied from the main register 34 to the note register 35.

When the note detect and assignor 14 detects that a keyboard switch has been actuated, a corresponding frequency number is read out from the frequency number memory 62 and is stored in the frequency number latch 63. In response to timing signals provided by the clock 15, the frequency number stored in the frequency number latch 63 is repetitively added to the content of an accumulator contained in the adder-accumulator 64. The memory address decoder 67 reads out data points stored in the note register 35 in response to the six most significant bits of the accumulated frequency number residing in the accumulator in the adder-accumulator 64.

The memory address decoder 67 also reads out the offset trigonometric function values stored in the sinusoid table 97. These are the same values stored in the corresponding numbered sinusoid table for the system embodiment shown in FIG. 1.

The offset trigonometric values read out from the sinusoid table 97 are scaled in magnitude by the multiplier 69 in response to a scale signal furnished by the scale signal generator 70.

The comparator 66 compares the data value produced by the multiplier 69 with the output value from the memory address decoder 67 to produce the signal T. The data select 72 selects the output data value from the note register 35 if T="0" signifying that the output data value from the multiplier 69 is less than the data output value from the memory address decoder 67. The data select 72 selects the output data value from the multiplier 69 if T="1" signifying that the output data value from the multiplier 69 is not less than the data output value from the memory address decoder 67.

The data values selected by the data select 72 are converted to an analog signal by means of the digital-to-analog converter 47. The analog signal is transformed into an audible musical sound by means of the sound system 11.

I claim:

1. In combination with a keyboard operated musical instrument having an array of keyswitches apparatus for producing a musical tone having a variable spectral content comprising;

an assignor means whereby a detect data word is generated in response to each actuated keyswitch in said array of keyswitches and whereby one of a plurality of tone generators is assigned to each said actuated keyswitch, a frequency number generator means whereby a frequency number is generated in response to each said detect data word and whereby said frequency number is provided to an associated one of said plurality of tone generators, said plurality of tone generators each of which comprises;

a waveshape memory for storing a preselected set of waveshape data words, a memory addressing means whereby said preselected set of waveshape data words are read out sequentially from said waveshape memory at a memory address advance rate responsive to said frequency number provided to said assigned tone generator, thereby generating a first sequency of waveshape data words, a data word generating means for generating a second sequence of waveshape data words, a data select means whereby data words in said first sequence of waveshape data words are selected periodically for a preselected interval of time and whereby data words in said second sequence of waveshape data words are periodically selected for a period of time during which data words in said first sequence of waveshape data words are note selected, and a means for generating a musical tone responsive to said waveshape data words selected by said data select means whereby said generated musical tone has a variable spectral content.

2. In a musical instrument according to claim 1 wherein said memory addressing means comprises;

a timing clock for providing timing signals, an adder-accumulator means comprising an accumulator and responsive to said timing signals wherein said frequency number assigned to said tone generator is successively added to the content of said accumulator to produce an accumulated frequency number, and a memory address decoder whereby a data word is read out from said waveshape memory at an address corresponding to said accumulated frequency number.

3. In a musical instrument according to claim 2 wherein said data word generating means comprises;

an adder-accumulator means comprising an accumulator and responsive to said timing signal wherein said assigned frequency number is successively added to the content of said accumulator to produce a second accumulated frequency and wherein said addition is modulo a prespecified modulo number, and a data value generation means whereby said second sequence of waveshape data words is generated in response to said second accumulated frequency number.

4. In a musical instrument according to claim 3 wherein said data value generation means comprises;

a sinusoid table for storing a plurality of trigonometric sinusoid function values, a sinusoid addressing means for reading out a trigonometric sinusoid function value from said sinusoid table in response to said second accumulated frequency number, and a multiplier means for multiplying each said trigonometric function value read from said sinusoid table by a preselected scale data value thereby generating said second sequence of waveshape data points.

5. In a musical instrument according to claim 3 wherein said data selects means comprises;

a comparator means whereby a select signal is generated if a data word in said second sequence of waveshape data words has a numeric value no less than the value of said second accumulated frequency number and whereby said select signal is not generated if a data word in said second sequence of waveshape data words has numeric value which is less than the value of said second accumulated frequency number, a second waveshape data word memory means for storing waveshape data words, a gating means whereby in response to said select signal a data word in said first sequence of waveshape data words read out from a corresponding waveshape memory is stored in said second waveshape data word memory means, and select gating means whereby waveshape data words are selected from said first sequence of waveshape data words in response to said select signal and whereby the data word stored in said second waveshape data word memory means is selected if said select signal is not generated.

6. In a musical instrument according to claim 3 wherein said data select means comprises;

a comparator means whereby a select signal is generated if a data word in said second sequence of waveshape data words has a numeric value no less than the value of said second accumulated frequency number and whereby said select signal is not generated if a data word in said second sequence of waveshape data words has a numeric value which is less than the value of said second accumulated frequency number, and a select gating means whereby waveshape data words are selected from said first sequence of waveshape data words in response to said select signal and whereby waveshape data words are selected from said second sequence of waveshape data words if said select signal is not generated.

7. In combination with a keyboard operated musical instrument having an array of keyswitches apparatus for generating a musical tone having a variable spectral content comprising;

a harmonic coefficient memory means for storing a preselected set of harmonic coefficients, a harmonic addressing means for reading out harmonic coefficients from said harmonic coefficient memory means, a waveshape memory means, a computing means responsive to said harmonic coefficients read out from said harmonic coefficient memory means whereby amplitude values of evenly spaced points defining the waveform of a musical tone are computed and stored in said waveshape memory means, an assignor means whereby a detect data word is generated in response to an actuated keyswitch in said array of keyswitches, a frequency number generator means whereby a frequency number is generated corresponding to said detect data word, a memory addressing means for reading out data words stored in said waveshape memory means at a memory address advance rate corresponding to said frequency number thereby generating a first sequence of waveshape data words, a data word generating means responsive to said frequency number whereby a second sequence of waveshape data words is generated, a data select means whereby data words in said first sequence of waveshape data words are periodically selected for a preselected time interval and whereby data words in said second sequence of waveshape data words are selected when said first waveshape data words are not selected, and a means for generating a musical tone responsive to said waveshape data words selected by said data select means thereby generating said musical tone having a variable spectral content.

* * * * *